US008733324B2

(12) United States Patent
Blizard et al.

(10) Patent No.: US 8,733,324 B2
(45) Date of Patent: May 27, 2014

(54) FUEL HEATING SYSTEM AND METHOD

(75) Inventors: Norman C. Blizard, Columbus, IN (US); Thomas O. Hahn, Columbus, IN (US); Cary J. Marston, Columbus, IN (US); Damon C. Salo, Columbus, IN (US); Kent A. Lobsiger, Nashville, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 423 days.

(21) Appl. No.: 13/019,058

(22) Filed: Feb. 1, 2011

(65) Prior Publication Data

US 2011/0214643 A1 Sep. 8, 2011

Related U.S. Application Data

(60) Provisional application No. 61/304,959, filed on Feb. 16, 2010.

(51) Int. Cl.
*F02M 55/00* (2006.01)
*F02M 31/02* (2006.01)

(52) U.S. Cl.
USPC ..... 123/468; 123/557; 123/514; 123/553

(58) Field of Classification Search
USPC ..... 123/557, 549, 545, 553, 41, 142.5 R, 123/456, 467, 468–472
See application file for complete search history.

(56) References Cited

U.S. PATENT DOCUMENTS 2,400,838 A * 5/1946 Olson ..... 219/208
2,627,258 A * 2/1953 Mariska ..... 123/142.5 R
3,604,502 A * 9/1971 Morse et al. ..... 165/51
3,827,409 A * 8/1974 O'Neill ..... 123/458
3,964,459 A * 6/1976 Kimberley ..... 123/390
3,981,279 A * 9/1976 Bubniak et al. ..... 123/41.14
4,323,043 A 4/1982 Alderson
4,343,283 A 8/1982 Shepherd
4,548,187 A 10/1985 Olsson et al.

(Continued)

FOREIGN PATENT DOCUMENTS

EP 0318514 B1 1/1995

*Primary Examiner* — Stephen K Cronin
*Assistant Examiner* — Gonzalo Laguarda
(74) *Attorney, Agent, or Firm* — Faegre Baker Daniels LLP

(57) ABSTRACT

This disclosure relates a system for heating fuel supplied by a common rail fuel supply to an internal combustion engine. The system includes a high pressure fuel line, plural fuel injectors connected in series along the high pressure fuel line in the common rail, and a continuous low pressure passage including a heat exchanging portion in close proximity to the high pressure fuel line. A heated fluid source is operative to fluidly communicate with the continuous low pressure passage and circulate heated fluid to heat fuel present in the high pressure fuel line prior to, and during a cold start operation of the internal combustion engine. Other embodiments relate to a method of providing fuel to an internal combustion engine that includes sensing the temperature of fuel supplied to a fuel system and determining whether the sensed fuel temperature is greater than a predetermined value. The method includes circulating heated fluid in a continuous low pressure circuit to heat fuel present in a high pressure fuel line if the sensed fuel temperature is less than or equal to a predetermined value, and evacuating fluid for heating fuel from a portion of the continuous low pressure passage and fluidly connecting the evacuated portion of the continuous low pressure passage to a fuel leakage detection device if the sensed fuel temperature is greater than the predetermined value.

27 Claims, 5 Drawing Sheets

(56) References Cited

U.S. PATENT DOCUMENTS

| | | | | | |
|---|---|---|---|---|---|
| 4,574,764 | A | * | 3/1986 | Earle | 123/545 |
| 4,612,896 | A | | 9/1986 | Leibrand, Sr. | |
| 4,934,330 | A | | 6/1990 | Lindsay | |
| 4,971,018 | A | * | 11/1990 | Ray | 123/557 |
| 5,097,813 | A | | 3/1992 | Reiser et al. | |
| 5,231,962 | A | * | 8/1993 | Osuka et al. | 123/299 |
| 5,611,392 | A | * | 3/1997 | Malecek et al. | 165/47 |
| 6,209,500 | B1 | * | 4/2001 | Tallio et al. | 123/179.21 |
| 6,345,611 | B1 | * | 2/2002 | Hartman et al. | 123/553 |
| 6,581,582 | B1 | * | 6/2003 | Lahti et al. | 123/557 |
| 6,827,065 | B2 | * | 12/2004 | Gottemoller et al. | 123/456 |
| 6,928,984 | B1 | | 8/2005 | Shamine et al. | |
| 7,302,936 | B2 | * | 12/2007 | Stolarz et al. | 123/468 |
| 8,015,793 | B2 | * | 9/2011 | Austin et al. | 60/39.52 |

* cited by examiner

FUEL HEATING SYSTEM AND METHOD

FIELD OF THE INVENTION

The invention relates to a system and method for heating fuel supplied to an internal combustion engine.

BACKGROUND

High pressure fuel delivery systems utilize a common rail to accumulate and distribute fuel to fuel injectors at high-pressure while minimizing pressure fluctuations among the injectors. The rail functions as an accumulator to allow for precise control of high-pressure injection of fuel by an engine control unit (ECU) into the cylinders of an internal combustion engine at timing that is independent from the engine speed. Such high pressure fuel delivery systems are susceptible to leakage from the fuel line or elsewhere in the delivery system. If fuel leakage occurs, the leaking fuel can spray onto high temperature surfaces of an engine and cause a fire. To control fuel leakage when it does occur, a low pressure containment system has been used to channel leaking fuel to a containment tank or to return the leaking fuel to the fuel tank or the fuel pump. One such conventional containment system uses a double wall structure, which encloses a high pressure fuel line with an outer wall to form a low pressure passage between the inner high pressure line and the outer wall. A fuel leak that may develop in the high pressure fuel line would be contained in the low pressure passage.

Additionally, recent fuel systems have modified the accumulator of the common rail from a single tube-like structure from which fuel is supplied to multiple injections to a more modular approach in which a fuel injector body itself includes a volume that functions as an accumulator with pressures maintained as high as 23,000 psi (1600 bar). These modular components eliminate the need for a costly long external fuel rail by maintaining a highly pressurized fuel volume within the injector.

SUMMARY

A system for heating fuel and method of heating fuel supplied to an internal combustion engine is provided by the invention.

More particularly, embodiments consistent with the claimed invention relate to a system for heating fuel supplied by a common rail fuel supply to an internal combustion engine. The system includes a high pressure fuel line, plural fuel injectors connected in series along the high pressure fuel line in the common rail, and a continuous low pressure passage including a heat exchanging portion in close proximity to the high pressure fuel line. A heated fluid source operative to fluidly communicate with the continuous low pressure passage and circulate heated fluid to heat fuel present in the high pressure fuel line prior to, and during a cold start operation of the internal combustion engine.

In other embodiments consistent with the invention, a method of providing fuel to an internal combustion engine includes sensing the temperature of fuel supplied to a fuel system of the internal combustion engine and determining whether the sensed fuel temperature is greater than a predetermined value. If the sensed fuel temperature is less than or equal to a predetermined value, the method recirculates fluid through a continuous low pressure circuit to heat fuel present in a high pressure fuel line. If the sensed fuel temperature is greater than the predetermined value, the method evacuates fluid for heating fuel from a portion of the continuous low pressure passage and the evacuated portion of the continuous low pressure passage is fluidly connected to a fuel leakage detection device.

In accordance with other embodiments consistent with the invention, an internal combustion engine includes an engine block including plural cylinders, where each cylinder contains a piston movable in a reciprocating manner. The internal combustion engine includes a fuel line for supplying fuel under high pressure to plural fuel injectors, where each fuel injector is controlled to deliver timed charges of atomized fuel to an associated one of the cylinders. A high pressure fuel pump fluidly communicates with the fuel line, an electronic controller, and a heated fluid recirculating circuit. The heated fluid recirculating circuit includes a heated fluid source, a feed line fluidly communicating with the heated fluid source, a heat exchanger having a low pressure passageway surrounding a portion of the fuel line and first and second distal ends. The first distal of the heat exchanger fluidly communicates with the feed line, and a return line fluidly communicates between the second distal end and the heated fluid source. The electronic controller is operative to cause the heated fluid recirculating circuit to circulate heated fluid from the heated fluid source through the low pressure passageway of the heat exchanger to heat fuel under high pressure in fuel line prior to, and during a cold start operation of the internal combustion engine.

It is to be understood that both the foregoing general description and the following detailed description are exemplary and exemplary only and are not restrictive of the invention, as claimed.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention. In the drawings.

DETAILED DESCRIPTION

The various aspects are described hereafter in greater detail in connection with a number of exemplary embodiments to facilitate an understanding of the invention. However, the invention should not be construed as being limited to these embodiments. Rather, these embodiments are provided so that the disclosure will be thorough and complete, and will fully convey the scope of the invention to those skilled in the art. Descriptions of well-known functions and constructions are omitted for clarity and conciseness. Further, it should be emphasized that the terms "comprises" and "comprising," when used in this specification, are taken to specify the presence of stated elements, features, integers, steps or components; but the use of these terms does not preclude the presence or addition of one or more other elements, features, integers, steps, components or groups thereof.

Standby power generation units as well as industrial, mobile and marine engines may be required to go from a cold soak cold start condition (−30° F.) to full rated speed and power within a few seconds of starting. For example, the NFPA (National Fire Prevention Association) requirement is 85% of rated speed to accept load within 10 seconds of cold start. By cold start condition is meant a condition of the internal combustion engine determined based on input(s) from one or more sensors provided on or around the engine that can be relayed to a controller, such as an engine control module (ECM) or electronic engine controller (EEC). For example, an ECM, EEC or other controller can determine the existence of a cold start condition by comparing one or more engine parameters to predetermined threshold values. For example, a cold start condition can be determined to exist by the comparison of fuel temperature and/or engine coolant temperature with a predetermined temperature threshold. Likewise, other engine conditions may be utilized for determining cold start conditions, such as catalyst temperature, ambient temperature, etc. These engine parameters can include, for example, oil temperature, exhaust temperature, intake air temperature, ambient temperature, and so forth. A cold start operation includes starting and/or operating an internal combustion engine while in a cold start condition.

Figure 5:
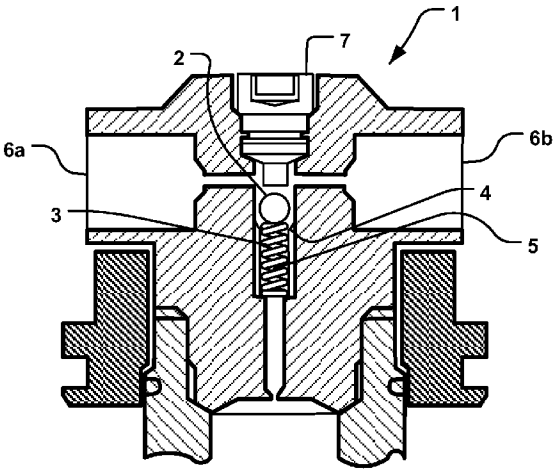
FIG. 5 is a diagram of an exemplary fuel injector T piece.

During the transient period from zero speed and fueling to full rated speed and fueling, cold viscous fuel from the fuel lines, fuel pump and low pressure filtration system can pass by a flow limiter or flow fuse provided in the high pressure portion of the fuel line supply. For example, FIG. 5 shows a flow limiter in a fuel injector T piece 1, which includes a ball 2, spring 3, seat 4, annular flow area 5, fuel inlet or fuel inlet port 6*a*, fuel outlet or fuel outlet port 6*b* and plug 7, although a flow limiter or flow fuse can be located elsewhere in the fuel path of a common rail arrangement. This fuel injector T piece 1 permits "daisy chaining" plural injectors in a series where a continuous high pressure passage is in fluid communication with all the fuel injectors. Flow limiters, such as flow limiter 1, are designed to close under normal operating conditions only if the actual fueling exceeds the commanded fueling by a gross amount, for example, due to a pilot valve or nozzle needle valve stuck in the open position. Such closing of a flow limiter prevents progressive damage to the engine from overfueling. However, under a cold start condition, fuel can become more viscous and can create a high pressure drop across portions of a flow limiter, for example, across the ball 2 and annular flow area 5 of the flow limiter shown in FIG. 5, causing the flow limiter to close or seat. These unintended valve closings can curtail fuel flow to an associated injector and prevent an engine from achieving full speed and power, thus preventing the engine from achieving required standby power. While eliminating flow limiters is one available option that would avoid this problem, doing so would expose an engine to progressive damage through overfueling in the event that the pilot valve or nozzle needle becomes stuck open.

Figure 1:
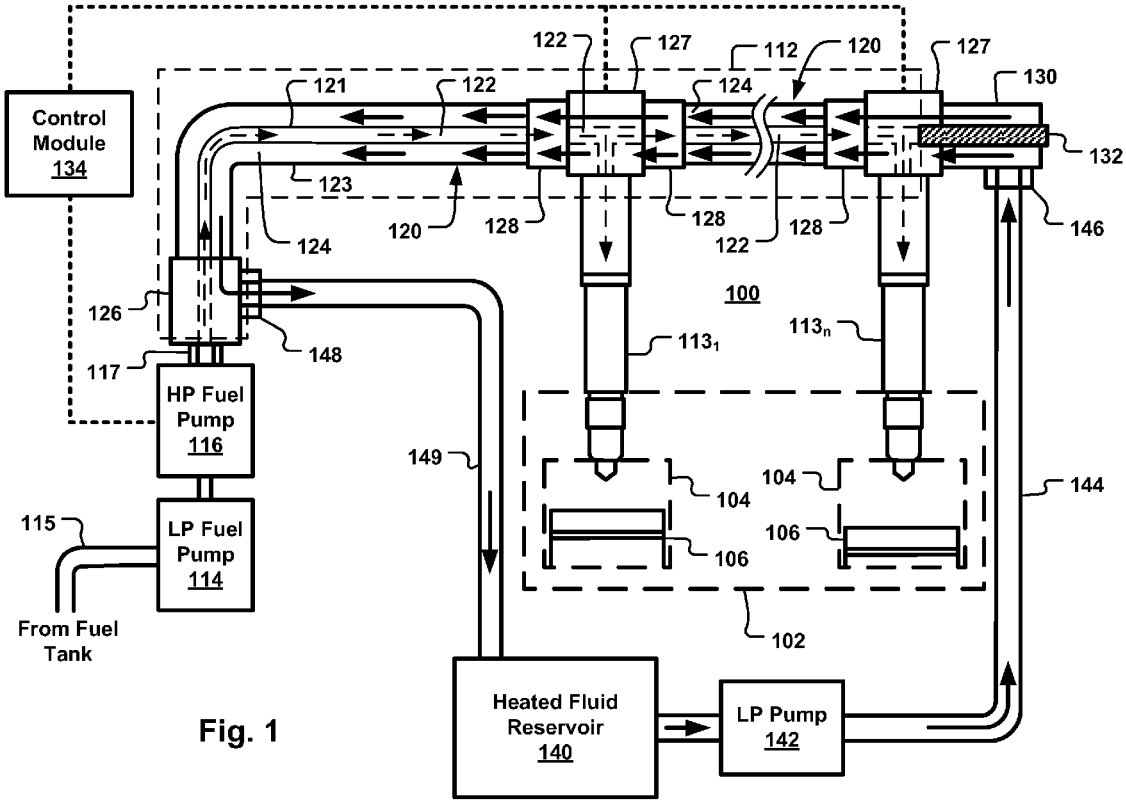
FIG. 1 is a schematic diagram of a fuel supply system for heating fuel supplied to an engine in a common rail common rail configuration according to an exemplary embodiment.

Referring now to FIG. 1, an embodiment of a fuel supply system 100 can heat fuel supplied to an internal combustion engine 102 including plural cylinders 104, each of which a piston 106 movable in a reciprocating manner within its associated cylinder 104. The fuel system 100 is a common rail configuration that includes a heat exchanging portion 112 in which heat from fluid circulating near the fuel line exchanges with the fuel in the line to limit the viscosity of fuel supplied to each of a series of daisy chained fuel injectors $\mathbf{113}_1$ to $\mathbf{113}_n$, each of which is controlled to deliver timed charges of atomized fuel under high pressure to an associated one of the cylinders 104. Because fuel is heated in the high pressure portion of the fuel system including flow limiters, fuel supply system 100 minimizes occurrence of unintended valve closings from vicious fuel flow.

As shown in FIG. 1, fuel system 100 includes a low pressure fuel pump 114 that draws fuel from a fuel tank or reservoir (not shown) through a low pressure fuel line 115. The fuel output from the low pressure (LP) pump 114 may be passed through a filter (not shown) before being provided to a high pressure (HP) fuel pump 116, which provides fuel at high pressure to double walled heat exchanging segments 120 connecting the fuel injectors 113 in the heat exchanging portion 112.

Each double walled segment 120 includes an inner line 121 that forms a portion of a high pressure fuel passage 122 that extends at least the length of the heat exchanging portion 112, and an outer line 123 surrounding the inner line 121 to form an annular shaped low pressure passage 124 that is part of a low pressure circuit extending beyond the heat exchanging portion. As will be described below in detail, heated fluid can be circulated through the low pressure passage 124 to heat fuel supplied in the high pressure fuel passage 122. The number of double walled segments 120 can correspond to the number, n, of fuel injectors, for example, a number that is equal to the number of cylinders 104 included in a bank of cylinders of an engine, although some applications can include additional segments or only one segment for an engine having a single cylinder. For example, embodiments can include modular elements of various shapes and lengths that provide increased flexibility in applications requiring different fuel routing paths and/or branches to multiple paths, or to permit insertion of intermittent elements, such as sensors and valves.

As shown in FIG. 1, a first segment of the double walled segments 120 has one end sealingly connected to an outlet 117 of the HP fuel pump 116 using a coupler 126, and another end sealingly connected to a T piece 127 of the fuel injector $\mathbf{113}_1$ via a coupler 128. Additional couplers 128 connect ends of additional double walled segments 120 positioned between the fuel injectors $\mathbf{113}_1$ and $\mathbf{113}_n$ to provide sealed connections of the inner and outer lines 121, 123 to the fuel injector T's 127. In this way, a continuous high pressure passage 122 can be provided from an outlet of the HP fuel pump 116 to the last fuel injector $\mathbf{113}_n$ in the series of fuel injectors. In the depicted embodiment, the high pressure passage 122 is terminated at an outlet of the T piece 127 of the fuel injector $\mathbf{113}_n$ with a coupler 130, which includes a plug 132 that seals the high pressure fuel passage at a distal end of the heat exchanging portion 112.

The annular shaped low pressure passage 124 is part of a heated fluid circuit that includes a heated fluid reservoir 140, a low pressure (LP) pump 142, and feed line 144 for providing the heated fluid from the heated fluid reservoir 140 to an inlet 146 of the coupler 130. After the heated fluid enters the coupler 130, it flows through the heat exchanging portion 112 in the direction of solid tailed arrows depicted in FIG. 1 to the coupler 126 and exits the coupler 126 through outlet 148 to a low pressure return line 149 connected between the outlet 148 and the heated fluid reservoir 140. The heated fluid circuit includes a continuous loop of coolant or other heated fluid flowing in the low pressure annular area 124. In some embodiments, the recirculated heated fluid can be coolant fluid heated in an engine block reservoir, for example, to 100° F. or higher using an electrical block heater or another heating system that can transfer heat to the circulated fluid. In other embodiments, the recirculated heating fluid can be heated in a reservoir separate from the engine block using an electrical heat source, although other energy sources can be used for a heat source. While the LP pump 142 ensures circulation flow in the low pressure heated fluid circuit from the heated reservoir to the pump to the double wall pipe and back to the reservoir, heated fluid can alternatively be recirculated via convective flow.

The recirculated heated fluid flowing through the heat exchanging portion 112 keeps fuel residing in the high pressure passage 122 and the injectors 113 warm and at low viscosity. For example, a target viscosity can be under 6 centistokes, which is approximately 40° F. for straight #2 diesel fuel (e.g., ASTM D975 #2), although the temperature for maintaining fuel below a target viscosity would depend on the type of fuel being used. For instance, respective temperatures required for maintaining a target viscosity would increase for the following fuels in the order of: jet fuel, typical #1 diesel, typical #2, moderate #2, and high viscosity #2. Viscosities above this range can close a flow limiter associated with a fuel injector, so maintaining fuel viscosity below about 6 centistokes by applying heat to the fuel can prevent unintended closings. However, a target viscosity for a fuel also can depend on a type of fuel system, type of flow limiter, or another physical structure associated with a fuel's path in a high pressure fuel system.

To prevent heat loss from the flowing heated fluid, insulation can be added to the outside of the double wall segments 120, couplings 126, 128 and 130, the feed and return lines 144, 149, and/or all exposed surfaces of the injectors 113. Other heating means such as electrical tape or other active heating may also be used to augment the effect of the heated fluid recirculation.

Figure 2:
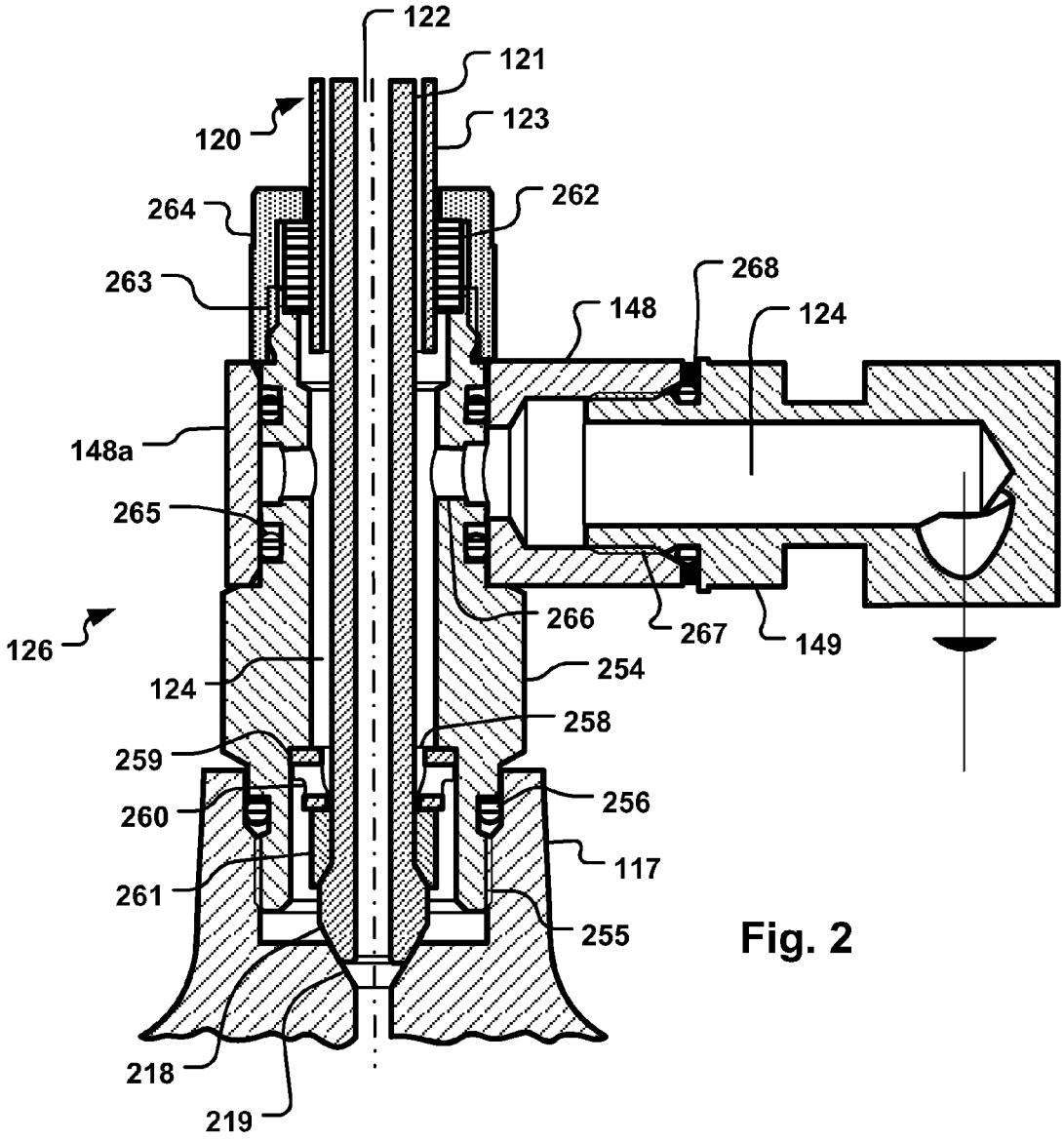
FIG. 2 is a diagram of an exemplary embodiment of an egress coupler positioned near the high pressure fuel pump in fuel system shown in FIG. 1.

FIG. 2 shows a more detailed cross sectional view of an embodiment of the coupler 126 broadly depicted in FIG. 1, a portion of an outlet 117 of the HP fuel pump 116, and a portion of the heated fluid return line 149. The coupler 126 can be considered an egress coupler in this embodiment because the heated fluid exits the coupler via return line 149 and is returned to the heated fluid reservoir. With respect to the high pressure passage 122, the coupler body 254 is connected to the HP pump 116 at a first end thereof by screwing a threaded end portion 255 of the coupler body 254 into the outlet 117 of the HP fuel pump 116. A sealing element 256, such as an O-ring, forms a seal between coupler body 254 and the outlet 117. A ledge 258 inside the coupler body 254 supports a spacer 259 that includes at least one channel 260 formed through the spacer 259 to allow heated fluid to thermally communicate and flow across the spacer 259. Another spacer 261 is supported by spacer 259 and has a conical or spherical seat that seats a portion of the inner high pressure line 121. The high pressure line 121 includes a head portion having a conical or special surface 218 at a distal end thereof to enable forming a sealed engagement with a complementary surface 219 of the outlet 117 of the HP fuel pump 116. To this end, the spacers 259 and 261 provide sufficient extension of the plug end 218 from the coupler body 254 and prevent movement of the inner high pressure line 121 in the horizontal direction when attaching the coupler body 254 to the outlet 117 of the HP fuel pump 116. With the high pressure line 121 connected to the outlet 117 of the HP fuel pump 116, a continuous high pressure passage 122 extends from the HP pump 116 through to the end of the inner high pressure line 121 of the double walled segment 120.

To form the low pressure passage 124, a second end portion of the coupler body 254 includes a bushing 262 that can be compressed in sealing engagement with an outer surface portion of the low pressure outer line 123 and the coupler body 354 by screwing a cap 264 onto threads 263 of the coupler body. The outlet 148 of the coupler 126 includes a rotatably adjustable sleeve portion 148*a* provided over the coupler body 254 with sealing elements 265, such as O-rings, provided therebetween and on both sides of at least one opening 266 provided in the coupler body 254. The opening 266 provides a communication path to the low pressure return line 149 via the outlet 148. The return line 149 and the outlet 148 are connected via a threaded engagement 267, and one or more sealing elements 268 provide a seal between the outlet 148 and the return line 149. A continuous low pressure passage 124 is thus formed from the annular area between the inner high pressure line 121 and the outer low pressure line 123, the area between the high pressure line 121 and the coupler body 254, the opening 266, and the extent of the low pressure return line 149.

Figure 3:
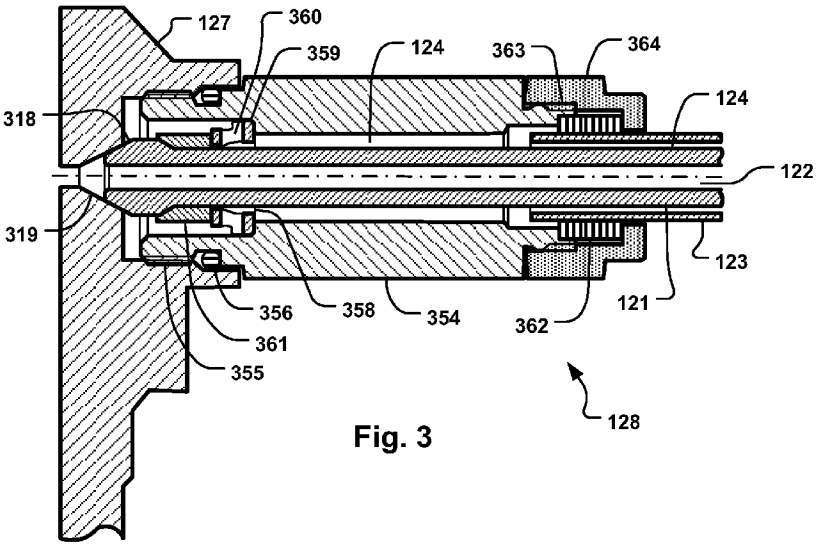
FIG. 3 is a diagram of an exemplary embodiment of a coupler used to connect two double wall segments in fuel system shown in FIG. 1.

FIG. 3 shows an exemplary embodiment of a coupler 128 that can connect a double walled segment 120 to a fuel injector T piece 127. For example, a coupler 128 can connect a to either a double walled segment 120 connected to the outlet of the HP pump 116 or to a double walled segment 120 providing a daisy chain connection with from an outlet port of the T piece 127 to an inlet port of another fuel injector T piece. The coupler 128 is connected to the T piece 127 at either an inlet or outlet port thereof by threaded engagement 355 of the coupler body 354 and the T piece inlet or outlet port and a sealing element 356, such as an O-ring, which forms a seal between the coupler body 354 and the inlet or outlet of the fuel injector T piece. Within the coupler body 354, a ledge 358 supports a spacer 359 that can include at least one channel 360 allow heated fluid to thermally communicate across the spacer 359. Supporting spacer 359 is another spacer 361 having a conical or spherical seat for seating an end portion of the inner high pressure line 121. The high pressure line 121 includes a conical or special surface 318 at a distal end thereof to form a sealed engagement with a complementary surface 319 of the fuel injector T piece 127, thus providing a continuous high pressure passage 122 extending from the fuel injector T piece 127 through the inner high pressure line 121. In some embodiments, a coupler can be positioned on each end of a double walled segment 120, for example, to provide a modular piece of desired shape for daisy chaining plural fuel injectors.

At a second end of the coupler body 354, a bushing 362 is compressed against an end portion of the low pressure outer line 123 by screwing a cap 364 onto the threads 363 of the coupler body 354. A continuous low pressure passage 124 is formed from the annular area between the inner high pressure line 121 and the outer low pressure line 123, the annular area between the high pressure line 121 and the coupler body 354, the channel 360, and the inlet or outlet port of the fuel injector T piece 127. Each fuel injector T piece 127 can include one or more low pressure passageway extending from its inlet port to its outlet port to provide continuity of the low pressure passage 124 through the T piece 127. Hence, heated fluid recirculated from the reservoir 140 can flow across the T piece 127 and the coupler 128 to exchange heat with fuel in the high pressure passage 122.

Figure 4A:
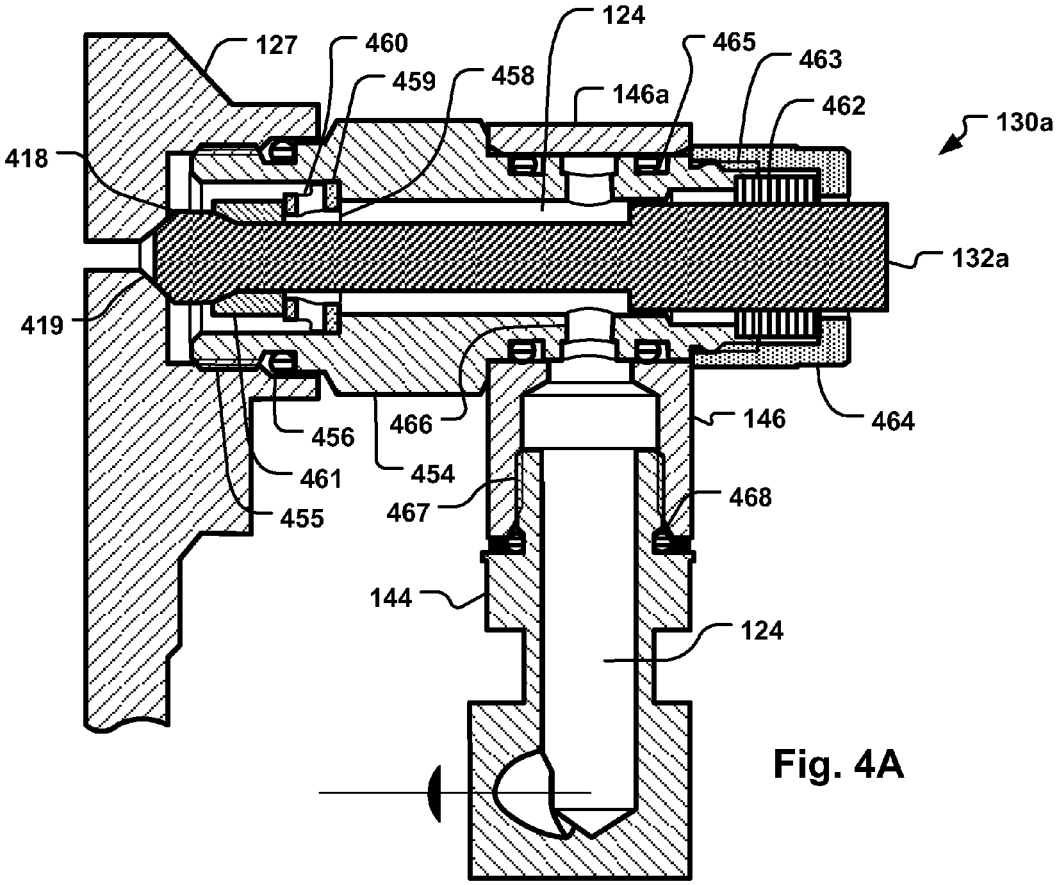
FIGS. 4A and 4B each show a diagram of exemplary embodiment of an ingress coupler positioned after the last fuel injector in a series of fuel injectors in fuel system shown in FIG. 1.
Figure 4B:
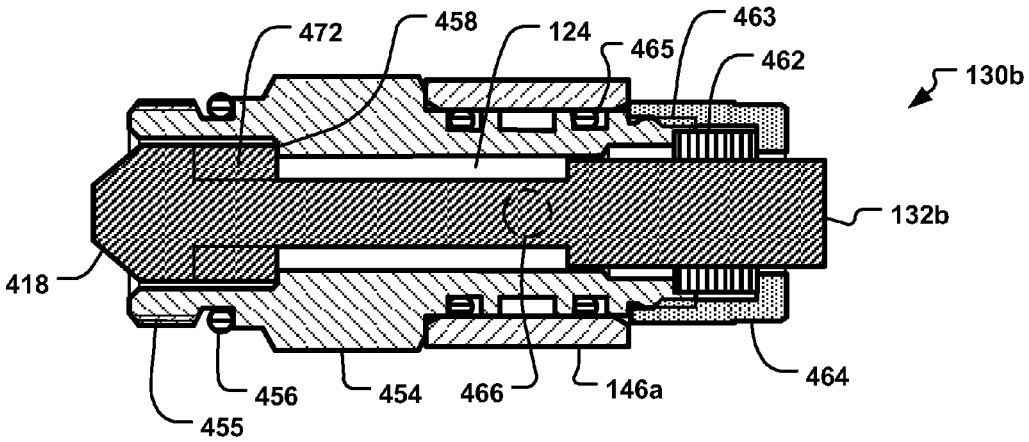

FIGS. 4A and 4B show more detailed cross sectional views of exemplary embodiments of the coupler 130 broadly depicted in FIG. 1, a portion of a fuel injector T piece 127 as depicted in FIG. 5, and a portion of the heated fluid feed line 144. The coupler 130 can be considered an ingress coupler in this embodiment because the heated fluid enters the coupler via feed line 144 from the LP pump 142. With reference to the FIG. 4A, a coupler 130*a* according to an embodiment includes a coupler body 454 having a threaded first end portion 455 attached to an outlet of the last fuel injector T piece 127 in the series of daisy chained fuel injectors 113 (not shown in FIG. 4A). Sealing element 456, such as an O-ring, forms a seal between coupler body 454 and the outlet of fuel injector T piece 127. As described above, the fuel injector T piece 127 includes, in addition to a high pressure passage for providing continuity of fuel supply through the high pressure passage 122, at least one low pressure passageway extending from its inlet port to its outlet port to provide continuity of the low pressure passage 124 through the T piece 127. However, coupler 130*a* includes a plug 132*a* that seals and terminates high pressure passage 124 of the fuel injector T piece 127. Plug 132*a* can be a solid element or otherwise configured to terminate the common rail. As shown in FIG. 4A, plug 132*a* can generally have the shape of an inner high pressure line 121 such that it has a head portion including a conical or spherical shaped end surface 418 in sealing engagement with the a complementary shaped surface 419 of the fuel injector T piece 127.

Similar to coupler 126 of FIG. 2, coupler 130*a* can include a ledge 458 within the coupler body 454 to support a spacer 459 that includes at least one channel 460 allowing heated fluid to flow across the spacer 459, and another spacer 461 supported by spacer 459 and having a conical or spherical seat that can seat a portion of the plug 132*a*. The spacers 459 and 461 provide sufficient extension of the plug end 418 from the coupler body 454 and prevent movement of the plug 132*a* in the horizontal direction when attaching the coupler body 454 to the fuel injector T piece 127.

To seal the low pressure passage 124 between the coupler body 454 and the plug 132*a*, the plug 132*a* can be sealingly engaged with a second end portion of the coupler body 454 by compressing a bushing 462 via screwing a cap 464 onto threads 463 of the coupler body 454. The inlet 146 of the coupler 130*a* includes a rotatably adjustable sleeve portion 146*a* provided over the coupler body 454 with sealing elements 465, such as O-rings, provided therebetween and on both sides of at least one opening 466 in the coupler body 454. The opening 466 provides a flow path for the heated fluid from the low pressure feed line 144 via the inlet 146. The heated fluid feed line 144 and the inlet 146 of the coupler 130*a* can be connected via a threaded engagement 467, and one or more sealing elements 468 can sealingly engage the outlet 148 and the return line 149. A continuous low pressure passage 124 is thus formed from the feed line 144, the opening 466, the area between the high pressure line 121 and the coupler body 254, and the low pressure passageway of the fuel injector T piece 127. As the couplers 126, 128, and double walled segments 120 described above, the coupler 130*a* can provide a high degree of modularity and efficiency in manufacturing. For example, comparing the coupler body 252 of FIG. 2 with the coupler body 454 of FIG. 4A, it can be seen that it is possible to use the same coupler body for both couplers 126 and 130*a*, although other configurations can be used.

FIG. 4B shows an embodiment of a coupler 130*b* that utilizes a plug 132*b* having an integrated supporting structure. The cross sectional view of the coupler 130*b* shown in FIG. 4B is of a plane perpendicular to a plane parallel with the central axis of the inlet 146, so opening 466, inlet 146, and the portion of feed line 144 shown in FIG. 4A are not visible in FIG. 4B, although the inlet 146 is shown in phantom. Additionally, the portion of the fuel injector T piece 127 shown in FIG. 4A is not shown in FIG. 4B. Like numbered elements shown in FIG. 4B are described above with respect to FIG. 4A. As shown in FIG. 4B, plug 132*b* includes channels 472 for allowing fluid to pass in passage 124.

Referring again to FIG. 1, arrows with dashed tails show the path of fuel flow as it travels in the high pressure passage 122 from the HP fuel pump 116 to each of the injectors $\mathbf{113}_1$ to $\mathbf{113}_n$, which provide timed and measured amounts of fuel to the cylinders of the engine under the control of a control module 134, such as an engine control module (ECU). The control module 134 can sense several conditions of the engine and fuel system 100, which can include sensing pressure and/or temperature of fuel in the HP pump 116 and the high pressure passage 122, and controls the fuel injectors $\mathbf{113}_1$ to $\mathbf{113}_n$ based on these sensed conditions.

The arrows with solid tails in FIG. 1 graphically depict the path of the heated fluid according to an embodiment in which the coupler 130 is utilized as an ingress and the coupler 126 as an egress, although the heated fluid circuit can alternatively be arranged to circulate heated fluid in the opposite direction so the coupler 126 is an ingress the coupler 130 is an egress for the heated fluid.

Some current fuel systems utilize double wall segments as a way to avoid potential hazards or undesirable situations that can occur with a rupture of the inner high pressure line, such as spraying high pressure fuel onto hot surfaces of an engine. In these systems, the low pressure outer line is a shell arrangement that captures this high pressure fuel spray or leakage and routes it back to a drain hose or sensor to detect the leakage and warn the operator that a fuel leakage has occurred. In normal operation of current systems, no fluid of any kind should exist in an area between the inner high pressure line and the outer low pressure line. By contrast, embodiments consistent with the claimed invention permit heated fluid, for example, hot engine coolant, to be circulated in that low pressure space during extended cold soak shutdown to keep the high pressure lines warm, and thus reduce the viscosity of fuel in these heated lines to avoid problems related to unintended flow limiter closings.

Rather than simply plugging an end of the double walled segment, embodiments include a new coupling to the last injector in the bank of daisy chained injectors to provide a low pressure heated fluid loop ingress or egress. A similar coupling can be installed near the outlet 117 of the high pressure fuel pump 116. These couplings can be connected by a flexible hose system to the circulation pump and coolant heater reservoir to form a heated fluid circuit.

In some embodiments, a fuel supply system can include one or more thermostats, actuators and valves that allow heated fluid to circulate through the closed low pressure loop including the heat exchanger, such as the double walled configuration described above, only when a cold start condition exists. When the fuel supply system is warmed through operation or the ambient environment, the low pressure loop can be opened to allow heated fluid to return to the heat fluid reservoir. This would enable switching, or converting portions of the low pressure passage including the heat exchanger between a first heated fluid recirculation mode, such as in embodiments described above, and a second dry mode where, in the event of fuel leakage from a rupture of the high pressure fuel line, leaking fuel is redirected to a leakage detection device, such as a low pressure fuel sensor and/or a tell-tale port that provides a visual indication that the heated fluid is present and the heating system.

Figure 6:
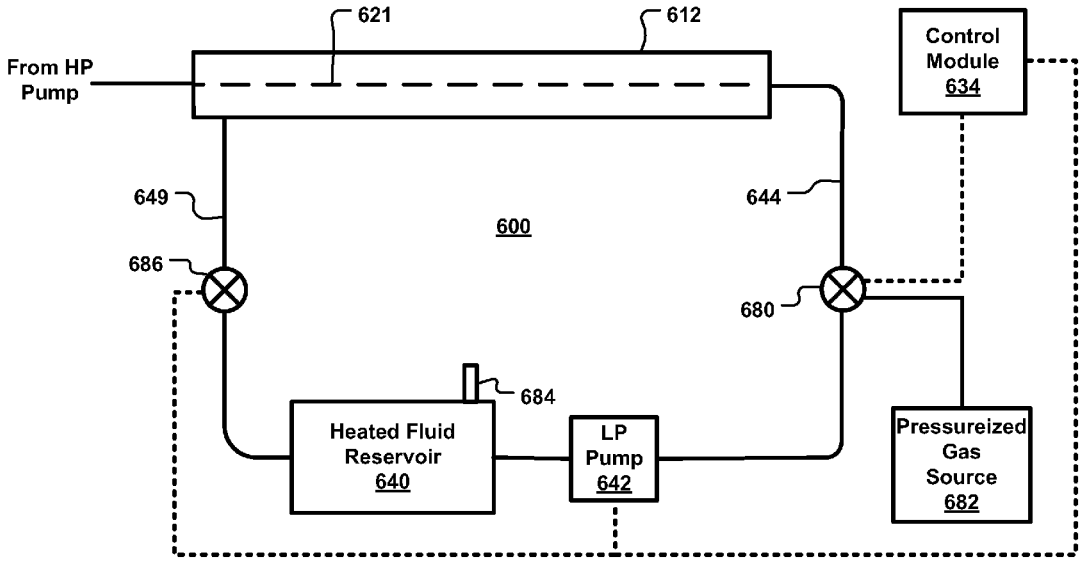
FIG. 6 is a diagram a portion of a fuel system that can convert portions of a heated fluid recirculating circuit to a fuel leakage containment and detection system according to an exemplary embodiment.

FIG. 6 shows an embodiment of a fuel system 600 that can convert portions of a heated fluid recirculating circuit to switch between a first heated fluid recirculation mode that heats fuel and a second dry mode that contains and detects fuel leakage from a high pressure fuel line. The fuel system 600 includes a heat exchanger/fuel containment housing 612 in which is provided a high pressure fuel line portion 621, which is fluidly connected to one or more fuel injectors (not shown). The heat exchanger/fuel containment housing 612 can include one or more sections that surround the high pressure fuel line portion 621, such that in the first mode during a cold start condition, heat from heated fluid present in the heat exchanger/fuel containment housing 612 can be transferred to fuel present in the high pressure fuel line portion 621. A low pressure feed line 644 is fluidly connected between a first end of the heat exchanger/fuel containment housing 612 and a low pressure (LP) pump 642. The LP pump 642 draws heated fluid from a heated fluid reservoir 640 and circulates the heated fluid through the feed line 644, the heat exchanger/fuel containment housing 612, a low pressure return line 649 fluidly connecting a second end of the heat exchanger/fuel containment housing 612 and the heated fluid reservoir 640, thus providing a closed low pressure loop, or low pressure circuit for recirculating heated fluid through the heat exchanger/fuel containment housing 612.

In the second dry mode, which can be activated or active when a cold start condition does not exist (i.e., when the fuel is at or less than a target viscosity), a portion of the low pressure loop including the heat exchanger/fuel containment housing 612 is purged of any heated fluid, and heated fluid is prevented from entering the purged portion of the low pressure loop. In this way, the purged portion of the low pressure loop is converted to a dry configuration that can contain fuel leakage in the event of a rupture in the high pressure fuel line portion 621.

To control conversion between the first and second modes, a temperature sensor (not shown) can be provided at a point along a low pressure or a high pressure portion of the fuel supply to sense the temperature of fuel supplied to the high pressure fuel line 621, although temperature sensors can be provided elsewhere, for example, in the fuel system, the ambient environment, and/or the engine, to determine whether a cold start condition exists. A control module 634 can monitor the sensed temperature and control the LP pump 642 based on the sensed temperature. For example, if the control module 634 determines the sensed temperature is above a predetermined threshold value for maintaining viscosity at below a target value, the control module 634 can turn off the LP pump 642, which causes the heated fluid source to cease circulating heated fluid. The system can then be purged using a multi-port valve 680 positioned along the path of the feed line 644. For example, two ports of the valve 680 can permit flowing circulated heated fluid from the LP pump 642 to the heat exchanger/fuel containment housing 612 during the first mode (i.e., during a cold start condition), but in the second mode the valve 680 shuts off the low pressure path leading from the LP pump 642 and momentarily allows pressurized gas from a pressurized gas source 682 that is fluidly connected to a third port of the valve 680 to enter the low pressure feed line 644, the heat exchanger/fuel containment housing 612, and the return line 649 to force the heated fluid in these portions into the heated fluid reservoir 640. A vent 684 can be provided at the heated fluid reservoir 640 to vent compressed gas blown into it during the momentary purge period. The pressurized gas source 682 can be an air compressor that supplies compressed air, for example, a shop compressor, although stationary and mobile applications can use other sources of pressurized gas, such as an air pump electrically or mechanically driven by the engine, exhaust gas from an operating engine's exhaust, stored compressed gas, etc.

After purging the heat exchanger/fuel containment housing 612 of heated fluid, the valve 680 shuts off the pressurized gas while continuing to close the path to the LP pump 642. Another valve 686 can be provided downstream of the heat exchanger/fuel containment housing 612 in the return line 649 and closed after purging the heated fluid to completely isolate the heated fluid reservoir 640 and LP pump 642 from the heat exchanger/fuel containment housing 612.

In some embodiments, the valve 680 and/or valve 686 can include a sufficient number of ports to provide fluid communication between the heat exchanger/fuel containment housing 612 and at least one fuel leakage detection device, although one or more fuel detection devices may be positioned elsewhere in the low pressure path of the low pressure feed line 644 downstream of the valve 680, the heat exchanger/fuel containment housing 612, and upstream of valve 686 in the return line 649.

Any of the above embodiments described with respect to FIGS. 1-5 can be combined with embodiments described above in connection with the fuel system 600 of FIG. 6. Also, a system that converts between the first (fuel heating) mode and the second (dry—fuel leakage detecting) mode can include various modifications from the system 600 described above. For example, a fuel system operating in a second mode can return heated fluid to a heated fluid reservoir using only gravity instead of a momentary application of compressed gas after turning off a recirculation pump.

The inner high pressure line and outer low pressure line material should be compatible with any type of fluids that can come into contact with them for long periods under the operating conditions (temperatures, pressures, pH etc.) to minimize deterioration such as corrosion. When selecting line material, characteristics to consider is strength, thermal-conductivity, and corrosion-resistance. Exemplary high quality line materials typically includes metals, such as copper alloy, stainless steel, carbon steel, non-ferrous copper alloy, Inconel, nickel, Hastelloy and titanium. Poor choice of line material can result in a leak through an inner high pressure line between the outer low pressure line shell, which can cause fluid cross-contamination and loss of pressure.

The fuel heating system and method described herein can be used in any of a variety of applications requiring an internal combustion engine, such as mobile and stationary heavy duty machines, vehicles including heavy and light duty trucks and automobiles, construction equipment and the like. Although a limited number of embodiments is described herein, one of ordinary skill in the art will readily recognize that there could be variations to any of these embodiments and those variations would be within the scope of the appended claims. For example, embodiments consistent with the present description can include a double walled configuration such as described in U.S. Pat. No. 6,928,984, the entire disclosure of which is hereby incorporated herein by reference. In this configuration, the common rail comprises double walled segments joined to one another and separated from each fuel injector by a flow limiter that taps the high pressure line of a double walled segment. From the present disclosure, modifications necessary to create a recirculation circuit including heated fluid consistent with the claimed subject matter would be readily apparent. Thus, it will be apparent that the invention described herein can be applied to fuel systems having plural injectors with one inlet port that are not configured in a daisy chain arrangement, such as described above with respect to FIGS. 1-5.

In addition to coolant as heated fluid in the above embodiments, heated fluid can include hot oil, hot water, steam, hot air or any other hot liquid or gas that can be circulated through the low pressure heated fluid loop. For example, standby power generators generally have a block heater that heats the oil and coolant contained therein to about 100° F., so a heater and heated fluid reservoir is already present in such existing applications.

Thus, it will be apparent to those skilled in the art that various changes and modifications can be made to the fuel heating system and method described herein without departing from the scope of the appended claims and their equivalents.

What is claimed is:

1. A system for heating fuel supplied by a common rail fuel supply to an internal combustion engine, comprising:

a high pressure fuel line;

plural fuel injectors connected in series along the high pressure fuel line in the common rail;

a continuous low pressure passage including a heat exchanging portion in close proximity to the high pressure fuel line;

a temperature sensing device operable to generate a signal indicative of a temperature of fuel present in the high pressure fuel line;

an electronic controller operable to switch between a first operation mode and a second operation mode based on the value of the generated signal; a heated fluid source operative to fluidly communicate with the continuous low pressure passage and circulate heated fluid to heat fuel present in the high pressure fuel line during said first operation mode; and a fuel leakage detection device operative to fluidly communicate with the continuous low pressure passage and detect fuel leakage from the high pressure fuel line in said second operation mode.

2. The fuel supply system of claim 1, wherein the high pressure fuel line and the heat exchanging portion of the continuous low pressure passage comprises plural double walled segments, each of said segments having an inner portion comprising a segment of the high pressure fuel line and an outer low pressure line comprising a segment of the continuous low pressure passage surrounding the high pressure line.

3. A system for heating fuel supplied by a common rail fuel supply to an internal combustion engine, comprising:

a high pressure fuel line;

plural fuel injectors connected in series along the high pressure fuel line in the common rail;

a continuous low pressure passage including a heat exchanging portion in close proximity to the high pressure fuel line;

a heated fluid source operative to fluidly communicate with the continuous low pressure passage and circulate heated fluid to heat fuel present in the high pressure fuel line prior to, and during a cold start operation of the internal combustion engine;

a first coupler including a plug terminating the high pressure fuel line after the last fuel injector of the series of fuel injectors and a passageway fluidly connected to the continuous low pressure passage;

a second coupler having a high pressure passageway for fluidly connecting to an outlet of a high pressure fuel pump and to the inner high pressure fuel line segment of one of the double walled segments, and a low pressure passageway fluidly connecting segments of the continuous low pressure passage, wherein the high pressure fuel line and the heat exchanging portion of the continuous low pressure passage comprises plural double walled segments, each of said segments having an inner portion comprising a segment of the high pressure fuel line and an outer low pressure line comprising a segment of the continuous low pressure passage surrounding the high pressure line.

4. The fuel supply system of claim 2, wherein at least one of said fuel injectors comprises:

a first port;

a second port;

a high pressure passageway connecting the first and second ports; and a low pressure passageway connecting the first and second ports, wherein one of the double walled segments has its inner high pressure fuel line segments sealingly connected to the high pressure passageway between the first and second ports, and its outer low pressure line segment connected the low pressure passageway between the first and second ports.

5. The fuel supply system of claim 1, wherein the heated fluid recirculating circuit comprises an electric heater for heating fluid recirculating in the continuous low pressure passage.

6. The fuel supply system of claim 5, wherein the electric heater is a block heater.

7. The fuel supply system of claim 1, wherein the heated fluid source comprises:

a heated fluid reservoir having an input port fluidly communicating with the continuous low pressure passage, and an output for supplying heated fluid to said continuous low pressure passage; and a pump fluidly communicating with the output of the reservoir and operative to circulate heated fluid through said continuous low pressure passage.

8. The fuel supply system of claim 1, wherein each of the fuel injectors is associated with a flow limiter valve.

9. The fuel supply system of claim 8, wherein the flow limiter valve is included in T piece of the each fuel injector.

10. The fuel supply system of claim 1, wherein said controller is further operable to control an amount of heat supplied to heat the high pressure fuel line based on the sensed temperature.

11. The fuel supply system of claim 1, wherein in the second operation mode, the controller causes the heated fluid source to cease circulating said heated fluid.

12. The fuel supply system of claim 11, further comprising:

means for purging the continuous low pressure passage of the heated fluid, wherein in the second operation mode, the controller causes the means for purging to cause the continuous low pressure passage to be purged of the heated fluid and fluidly connect to the fuel leakage detection device.

13. The fuel supply system of claim 12, wherein the fuel leakage detection device is a tell tale element.

14. The fuel supply system of claim 12, wherein the fuel leakage detection device comprises a low pressure fuel sensor.

15. A method of providing fuel to an internal combustion engine, comprising:

sensing the temperature of fuel supplied to a fuel system of the internal combustion engine;

determining whether the sensed fuel temperature is greater than a predetermined value;

recirculating fluid through a continuous low pressure circuit to heat fuel while present in a high pressure fuel line if the sensed fuel temperature is less than or equal to a predetermined value; and evacuating the fluid for heating the fuel from a portion of the continuous low pressure passage and fluidly connecting the evacuated portion of the continuous low pressure passage to a fuel leakage detection device if the sensed fuel temperature is greater than the predetermined value.

16. The method of claim 15, wherein the fuel leakage detection device comprises a low pressure fuel sensor.

17. The method of claim 15, wherein the fuel leakage detection device is a tell tale element.

18. An internal combustion engine, comprising:

an engine block including plural cylinders, each said cylinder containing a piston movable in a reciprocating manner;

a fuel line for supplying fuel under high pressure to plural fuel injectors, each said fuel injector controlled to deliver timed charges of atomized fuel to an associated one of the cylinders;

a high pressure fuel pump fluidly communicating with the fuel line;

a temperature sensing device operable to generate a signal indicative of a temperature of fuel present in the high pressure fuel line;

an electronic controller operable to switch between a first operation mode and a second operation mode based on the value of the generated signal;

a heated fluid recirculating circuit comprising:

a heated fluid source;

a feed line fluidly communicating with the heated fluid source;

a heat exchanger having a low pressure passageway surrounding a portion of the fuel line and first and second ends, said first end fluidly communicating with the feed line; and a return line fluidly communicating between said second distal end and said heated fluid source, wherein in said first operation mode the electronic controller is operative to cause the heated fluid recirculating circuit to circulate heated fluid from the heated fluid source through the low pressure passageway of the heat exchanger to heat fuel under high pressure in fuel line; and a fuel leakage detection device operative to fluidly communicate with the continuous low pressure passage and detect fuel leakage from the high pressure fuel line in said second operation mode.

19. The internal combustion engine of claim 18, wherein each fuel injector includes a flow limiter valve.

20. The internal combustion engine of claim 18, wherein the heated fluid recirculating circuit includes a heated fluid reservoir connected between the feed line and the return line.

21. The internal combustion engine of claim 20, wherein the heated fluid reservoir comprises coolant present the engine block, which is heated by an engine block heating device.

22. The internal combustion engine of claim 18, further comprising:

means for purging the continuous low pressure passage of the heated fluid, wherein in the second mode the controller controls the means for purging to purge the heating fluid from the low pressure passageway and fluidly connect said low pressure passageway to said fuel leakage detection device.

23. The internal combustion engine of claim 22, further comprising a low pressure pump connected to the feed line to circulate the heating fluid in the heated fluid recirculating circuit, wherein the controller is further operative to turn off the low pressure pump in the second operating mode.

24. The internal combustion engine of claim 22, wherein the heated fluid recirculating circuit comprises:

a first valve in the return portion of the low pressure passageway; and a second valve in the feed portion of the low pressure passageway, wherein fluidly connecting said low pressure passageway to said fuel leakage detector involves activating the first and second valves to prevent heated fluid flow from the heated fluid source and permit detection of a leak of fuel in the fuel line by said fuel leakage detection device.

25. The internal combustion engine of claim 22, wherein the heated fluid recirculating circuit comprises:

a valve in the path of the feed line;

a compressed gas line fluidly communicating with the valve, wherein the controller is operative to momentarily open the valve and allow compressed gas to enter the controller to perform said purge of heating fluid from the low pressure passageway.

26. The internal combustion engine of claim 22, wherein the fuel leakage detection device comprises a low pressure fuel sensor.

27. The internal combustion engine of claim 22, wherein the fuel leakage detection device is a tell-tale element.

* * * * *